US006412997B2

(12) United States Patent
Berke et al.

(10) Patent No.: US 6,412,997 B2
(45) **Date of Patent: *Jul. 2, 2002**

(54) PUMP AND LIQUID APPLICATOR APPARATUS FOR HEALTH AND BEAUTY PRODUCTS

(75) Inventors: Joseph J. Berke, 3248 Interlaken, West Bloomfield, MI (US) 48323; Charles T. Michael, Troy, MI (US)

(73) Assignee: Joseph J. Berke, West Bloomfield, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/440,195

(22) Filed: Nov. 15, 1999

(51) Int. Cl.[7] ..... A46B 5/02; A47L 1/08; B43M 11/06

(52) U.S. Cl. ..... 401/6; 401/138; 401/139; 401/183; 401/185; 401/186; 401/188 R; 401/205; 401/206

(58) Field of Search ..... 401/6, 137–140, 401/200, 205, 206, 183, 185, 186, 188 R, 263; 222/191

(56) References Cited

U.S. PATENT DOCUMENTS

| | | | | | |
|---|---|---|---|---|---|
| 2,800,673 | A | * | 7/1957 | Lazisky | 401/6 |
| 2,943,602 | A | * | 7/1960 | Rundle | 401/6 |
| 4,961,661 | A | * | 10/1990 | Sutton et al. | 401/6 |
| 5,308,180 | A | * | 5/1994 | Pournoor et al. | 401/205 |
| 5,908,256 | A | * | 6/1999 | Bernstein | 401/205 |
| 6,129,469 | A | * | 10/2000 | Messer et al. | 401/6 |

* cited by examiner

*Primary Examiner*—Gregory L. Huson
*Assistant Examiner*—Tuan Nguyen
(74) *Attorney, Agent, or Firm*—Alex Rhodes

(57) ABSTRACT

A liquid applicator apparatus for physically disadvantaged persons, but beneficial to all persons in showers, bathtubs and at the beach. The apparatus allows elderly and handicapped persons to apply health and beauty products to difficult and heretofore inaccessible body areas. It has a flexible reservoir for storing and dispersing liquid health or beauty products through an applicator. The applicator is attached to an end portion of a slender elongated tubular member with a single or plurality of ball and socket joints. In a first aspect of the invention, when the reservoir is squeezed, a portion of a stored liquid is dispersed through an open cell pad. In a second aspect, when the reservoir is squeezed, a portion of a stored liquid is dispersed through a plurality of small apertures. The elongated tubular member and ball and socket joints allow a user to apply the health and beauty products to difficult and heretofore inaccessible body areas.

12 Claims, 6 Drawing Sheets

PUMP AND LIQUID APPLICATOR APPARATUS FOR HEALTH AND BEAUTY PRODUCTS

FIELD OF THE INVENTION

This invention relates to a liquid storage and applicator apparatus and more particularly to a pump and liquid applicator apparatus for physically disadvantaged persons, but beneficial to all persons in showers, bathtubs and at the beach.

BACKGROUND OF THE INVENTION

Many physically disadvantaged persons, such as elderly, arthritics, amputees, paralytic and bedridden persons, are unable to attend to their health and grooming needs. This situation arises because some important body areas are inaccessible or difficult for these individuals to reach. The health and beauty products involved typically include sun screens, soaps, shampoos, body lotions and medications. The usual methods of using the hands or gauze to apply these products fail because of the muscular and joint limitations of such persons. Another problem is that liquid health and beauty products are often stored at remote locations or are stored in containers that are difficult to open.

Consequently, many persons must rely on others, such as hospital attendants, nurses, friends and. family members, for satisfying health and grooming needs. When assistance is not immediately available, these needs are often unmet or such persons are burdened with long delays. In some cases, these persons must be confined in institutions, such as hospitals, nursing homes and homes for the elderly.

Quite frequently persons who are not physically challenged need to relieve or apply lotions and medications to certain "itching" pruritic areas of their bodies which are remote or difficult for them to reach. The upper and middle regions of the back are exemplary of such areas. Other areas present problems of access while scrubbing, for cleanliness, before or after swimming or during bathing. The inability to apply sunscreen lotions or oils to the entire back region may result in severe sunburn.

SUMMARY OF THE INVENTION

The present invention overcomes all of the foregoing deficiencies by providing a means for physically disadvantaged persons for applying the products to body areas which have been inaccessible or difficult to reach. A primary object of the invention is to permit the physically disadvantaged persons to use these products without assistance. The invention is particularly applicable to bedridden persons in private homes, nursing facilities and hospitals where a need exists for bedridden persons to clean themselves or apply medications to irritated, itching and infected body areas.

Another object is to eliminate the long delays of meeting health and grooming needs which often occur in institutions such as hospitals and nursing homes. A further object is to reduce the amount of services to bedridden persons in hospitals and nursing homes. A further object is to provide an improved applicator apparatus which can be used by all persons in showers, bathtubs and at the beach.

The invention resides in its ability to store and efficiently apply liquid health and. beauty products to various regions of a person's body. The invention generally comprises a combined reservoir and pump, an elongated handle, an applicator, and a means for connecting the applicator to the handle which permits the applicator to be rotated about three mutually perpendicular axes. The applicator may be any of a variety of devices, such as an open cell sponge, brush, or loofah.

In a first aspect of the invention, a liquid health or beauty product is dispersed through an open cell sponge by squeezing a flexible reservoir. In a second aspect of the invention, a liquid health or beauty product is dispersed through a series of small openings by squeezing the flexible reservoir.

The foregoing objects, features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

In employing the teaching of the, present invention, a plurality of alternate constructions can be adopted to achieve the desired results and capabilities. In this disclosure, only several embodiments are discussed. However, these embodiments are intended as examples and should not be considered as limiting the scope of the invention.

BRIEF DESCRIPTION OF THE DRAWINGS

The invention will be better understood and further objects, characterizing features, details and advantages thereof will appear more clearly with reference to the diagrammatic drawings illustrating specific embodiments of the invention by way of non-limiting example only.

DETAILED DESCRIPTION OF A PREFERRED EMBODIMENT

Figures 1, 2, 3, 4, 5:
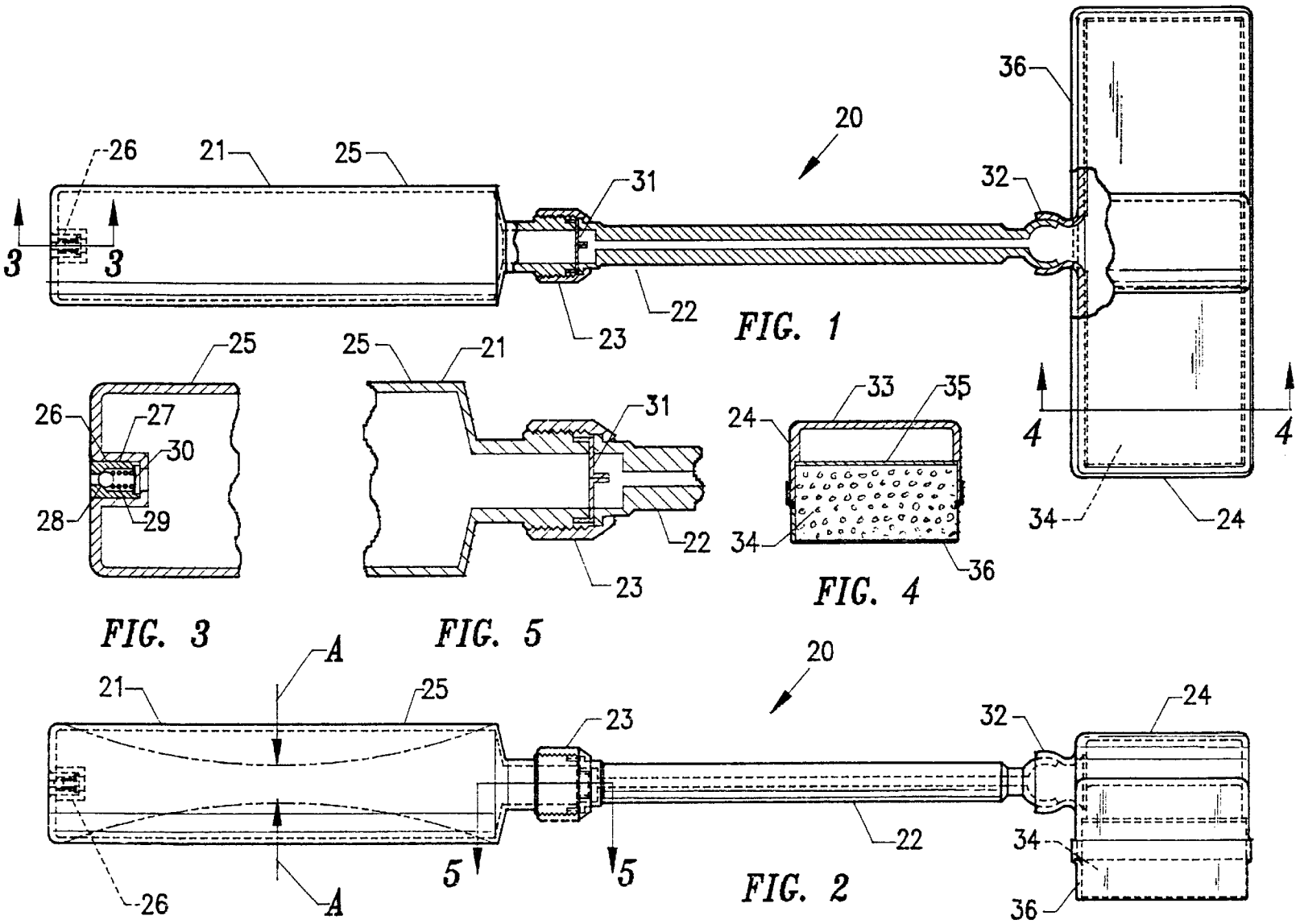
FIG. 1 is a plan view of a pump and liquid applicator apparatus according to the invention.
FIG. 2 is a right side view of the pump and applicator apparatus.
FIG. 3 is an enlarged cross-sectional view taken on the line 3—3 in FIG. 1.
FIG. 4 is a cross-sectional view taken on the line 4—4 in FIG. 1.
FIG. 5 is an enlarged cross-sectional view taken on the line 5—5 in FIG. 1.

Referring now to the drawings wherein like numerals designate like and corresponding parts throughout the several views, a first aspect of a pump and applicator apparatus 20 is shown in FIGS. 1 through 7, inclusive, which is exemplary of the invention. As shown in FIG. 1 the apparatus 20 is comprised of a slender cylindrical reservoir 21 for storing a liquid health and beauty product, a detachable elongated tubular member 22 which is connected with a threaded fitting 23 to an outlet end portion of the reservoir 21 and an applicator 24 which is attached to an end portion of the slender elongated tubular member 22. One advantage of the threaded fitting 23 is that a pre-filled disposable reservoir 21 may be used. Another advantage is that a variety of reservoirs 21 and applicators 24 can be combined.

The reservoir 21 includes a body 25 made of a flexible plastic material, such as polyethylene, whereby the reservoir can serve as a pump to discharge a portion of a liquid health or beauty product when the body 25 is held and squeezed, as shown in FIG. 2, in the direction of arrows A—A.

With reference to FIG. 3, at a closed end portion of the reservoir's body is a normally closed valve 26 for venting the reservoir 21. The valve 26 automatically opens after the body 25 is squeezed to replace the discharged portion of the liquid with air. The valve 26 is comprised of a valve body 27 having a conical seat, a ball 28, a spring 29 and retainer 30. Referring to FIG. 5, a flapper type valve 31 at the reservoir outlet, made of a flexible rubber material, automatically opens when the body 27 is squeezed to discharge liquid and closes after the liquid is discharged to prevent a further discharge of liquid.

With reference to FIGS. 1, 2 and 4. the generally rectangular applicator 24 is attached to a distal end portion of the elongated tubular member 22 with a hollow ball and socket joint 32. The applicator 24 is comprised of a housing 33 and an open cell flexible pad 34 mounted to the housing 33. The top of the cellular pad 34 is preferably covered with a permeable membrane 35 to distribute the liquid health or beauty product throughout the pad 34. A thin cover 36 surrounds the lower portion of the pad 34 and is removed when the apparatus 20 is used.

Figure 8:
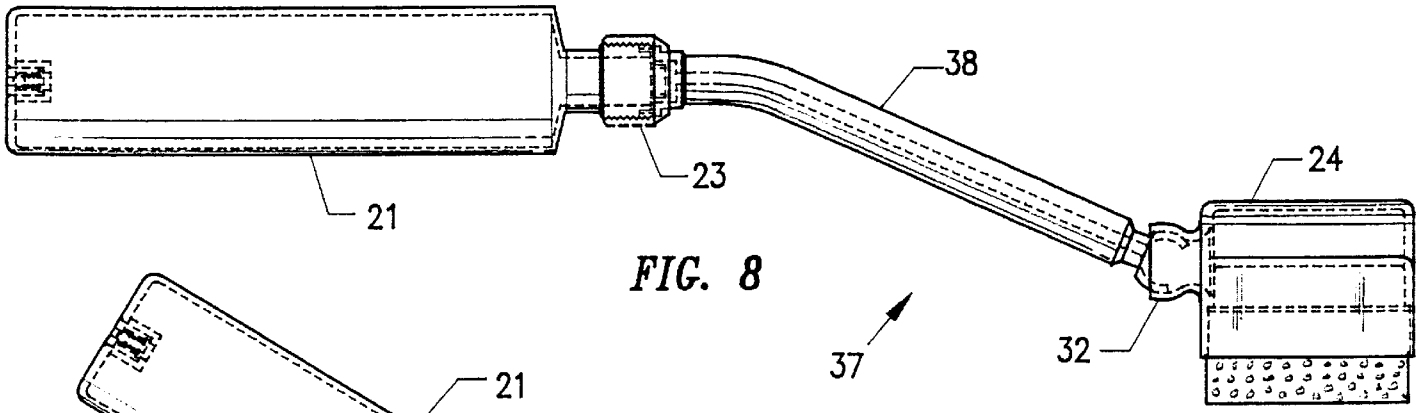
FIG. 8 is a right side view of a second embodiment.
Figure 7:
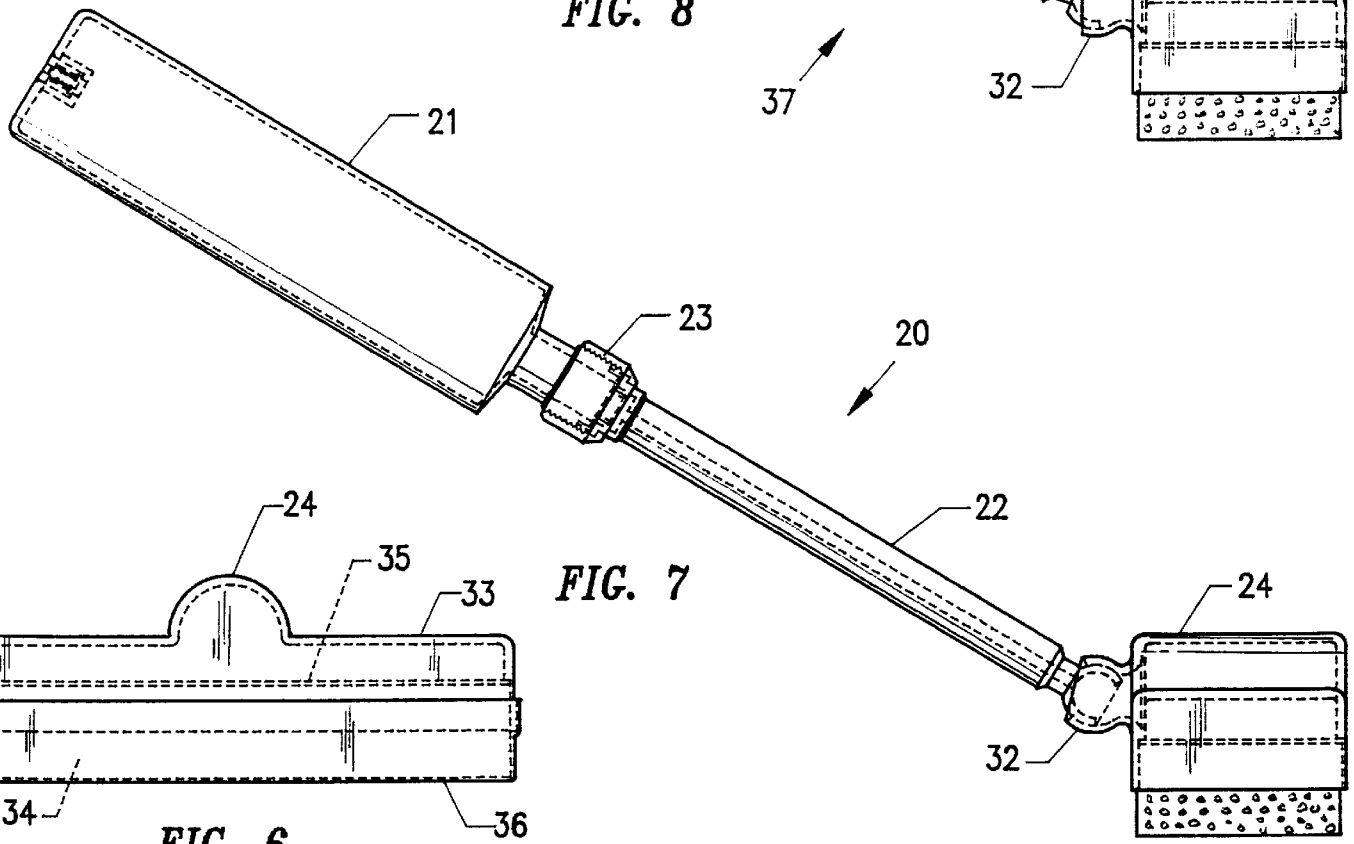
FIG. 7 is a right side view showing an optional orientation of the applicator.
Figure 6:
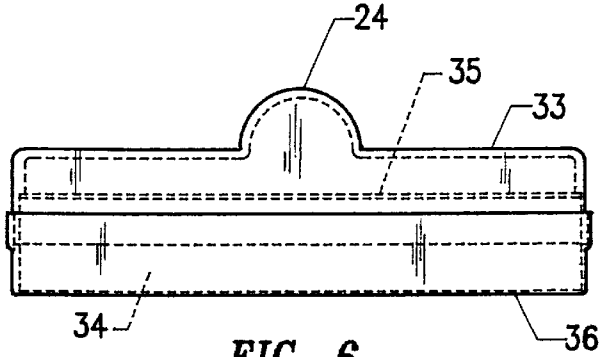
FIG. 6 is an enlarged end view of the pump and liquid applicator apparatus.

One important feature of the apparatus 20 is that the applicator 24 can be rotated about three mutually perpendicular axes. This allows the applicator 24 to be oriented as exemplified in FIG. 7 to reach a variety of body areas. In FIG. 8, an embodiment 37 is shown having a bent elongated tube 38.

Figure 9:
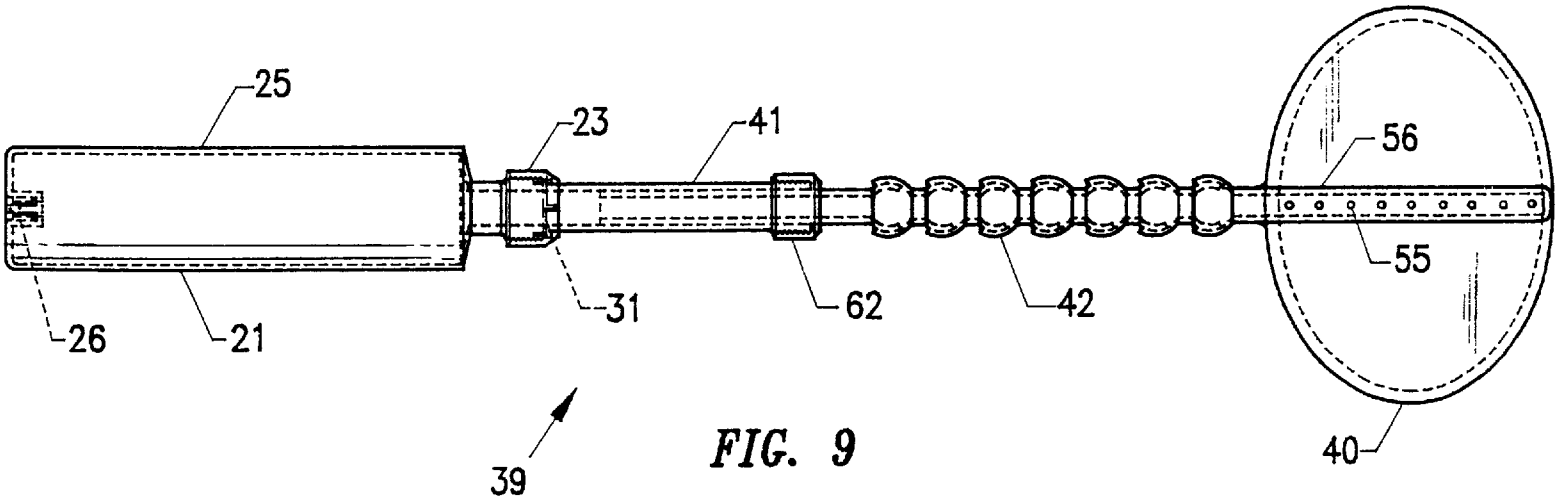
FIG. 9 is a plan view of a third embodiment.
Figure 10:
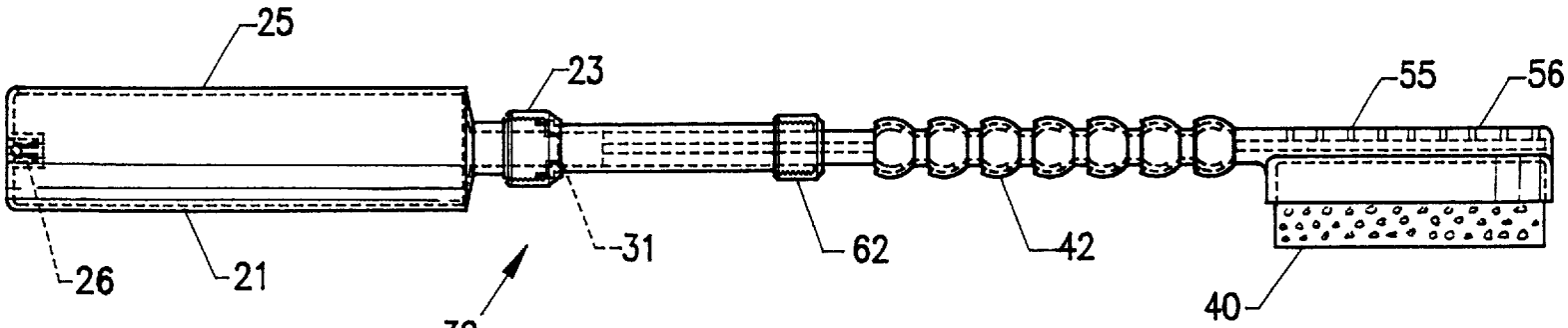
FIG. 10 is a right side view of the third alternate embodiment.
Figure 11:
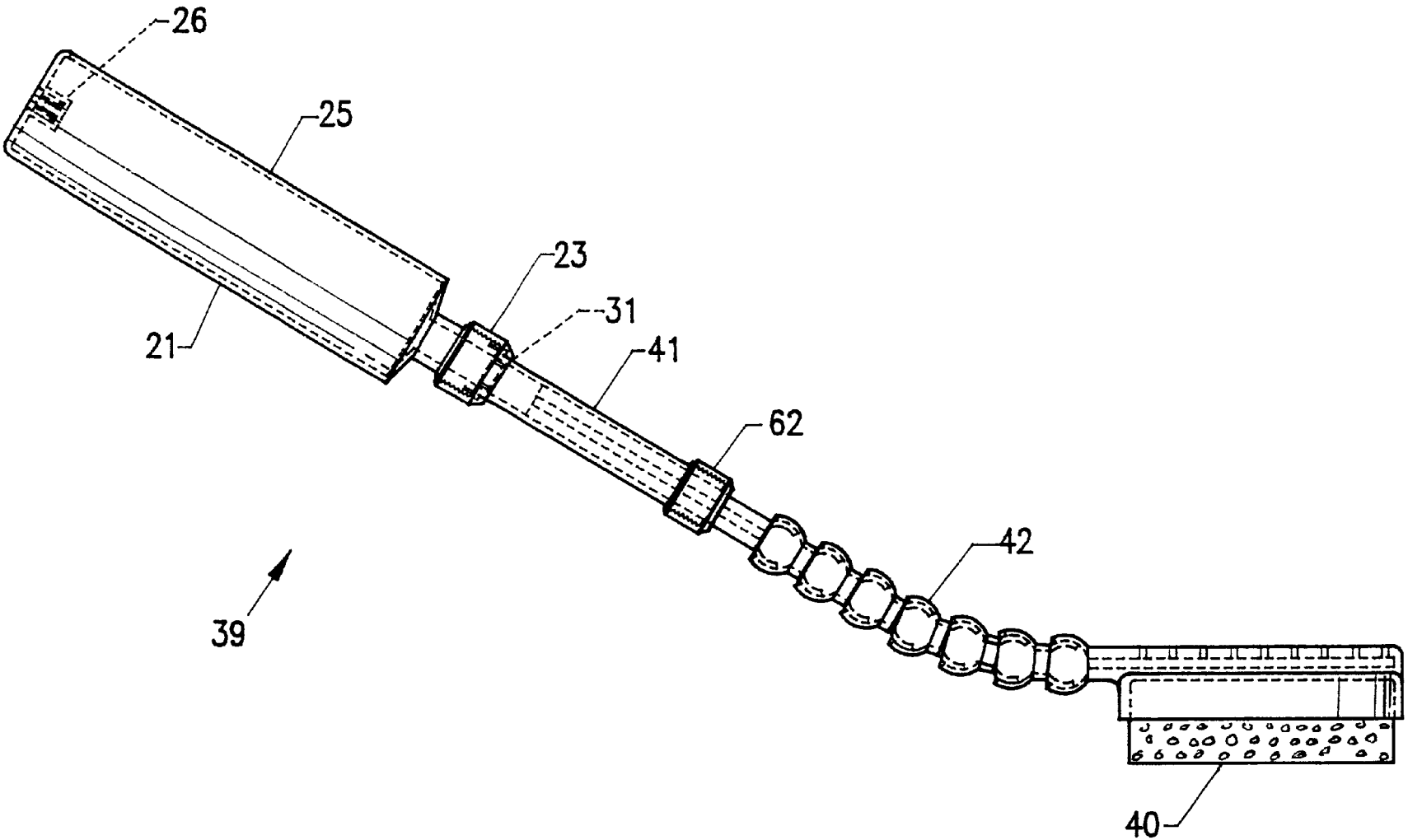
FIG. 11 is an optional configuration of the third embodiment.

Referring now to FIGS. 9 through 11, inclusive, another aspect 39 of the invention is depicted wherein a liquid health or beauty product is also sprayed through a series of small apertures 55 which extend through a small cylindrical upper portion 56 of an elliptical shaped applicator 40. The elliptical shaped applicator, 40 is joined to a plurality of hollow ball and socket joints 42 which are joined to an extensible slender elongated tubular member 41 with a coupling 62. The ball and socket joints 42 are made of a resilient plastic material, whereby their members can be forcibly engaged to prevent leakage and provide sufficient joint friction for maintaining the orientation of the applicator 40. One advantage of this embodiment 39 is that the elongated tube 41 can be lengthened to reach body areas and shortened for storing the apparatus 39. Another advantage is that the elongated tubular member 41 can be selectively bent as shown in FIG. 11 in addition to rotating the applicator 40 about three mutually perpendicular axes.

Figure 12:
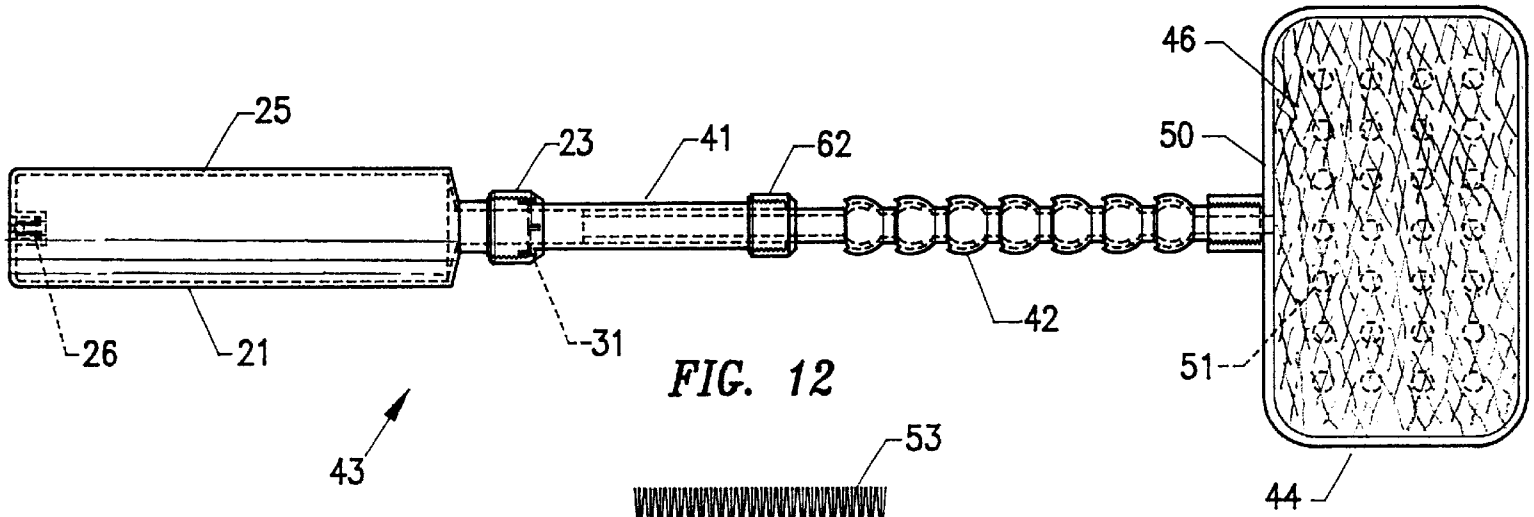
FIG. 12 is a plan view of a fourth embodiment.
Figure 14:
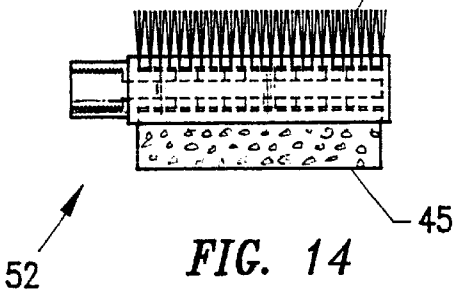
FIG. 14 is a right side view of a fifth embodiment.
Figure 13:
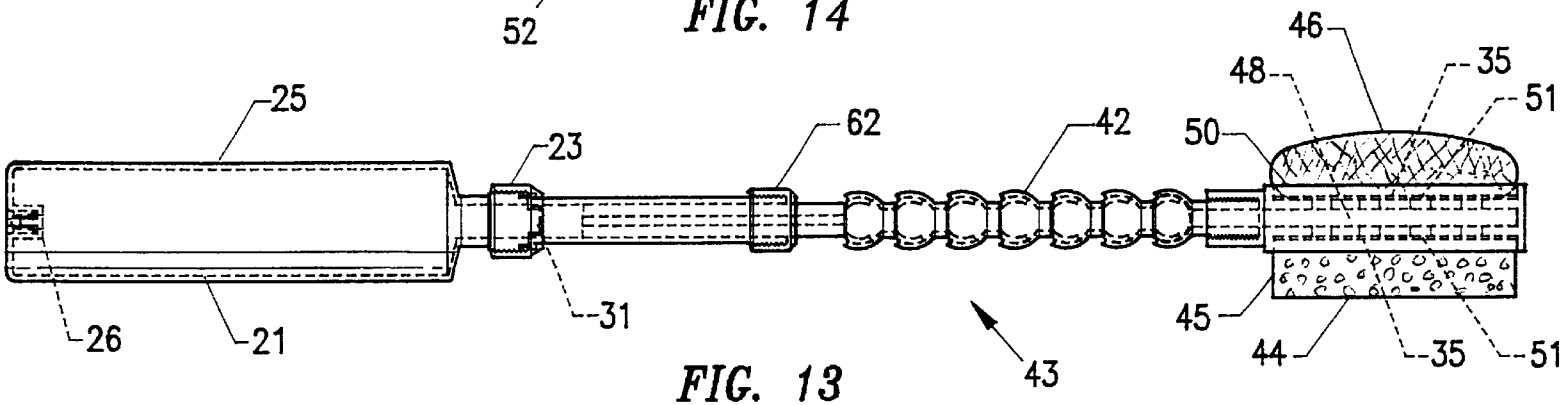
FIG. 13 is a right side view of the fourth embodiment.
Figure 15:
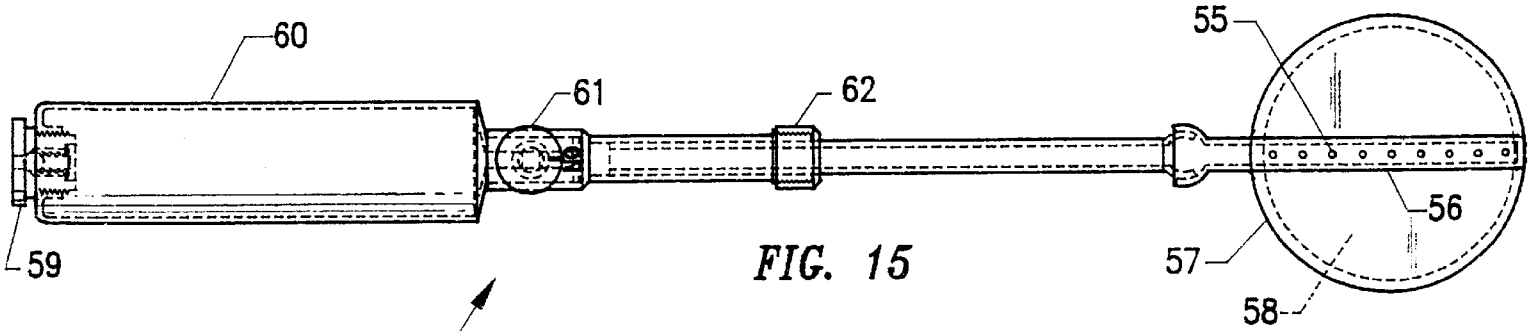
FIG. 15 is a plan view of a sixth embodiment.
Figure 17:
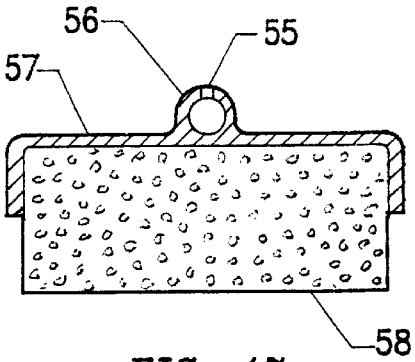
FIG. 17 is a cross-sectional view taken on the line 17—17 in FIG. 16.
Figure 18:
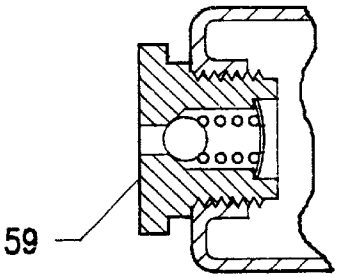
FIG. 18 is an enlarged cross-sectional view taken on the line 18—18 in FIG. 16.
Figure 19:
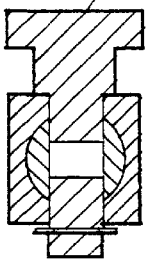
FIG. 19 is an enlarged cross-sectional view taken on the line 19—19 in FIG. 1.
Figure 16:
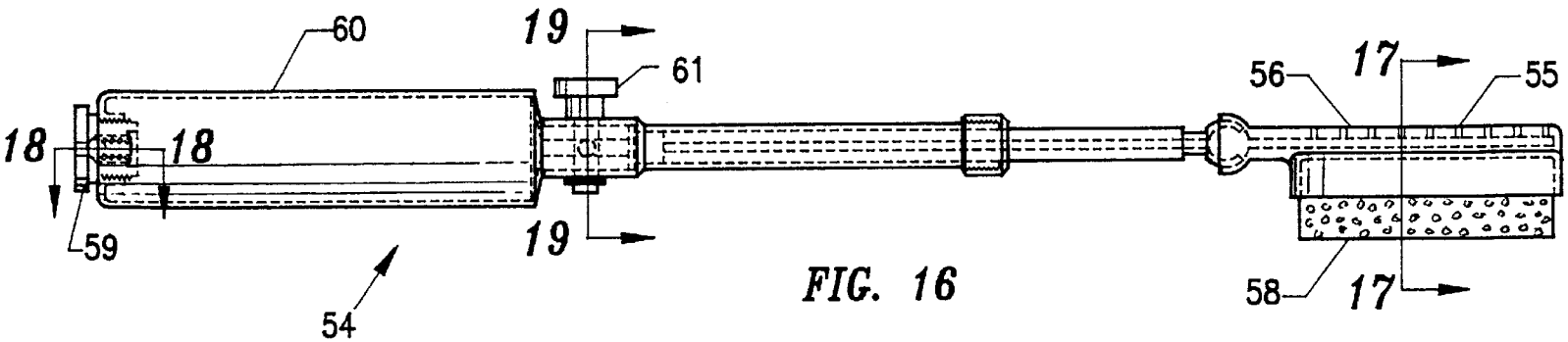
FIG. 16 is a right side view of the sixth embodiment.

In FIGS. 12 and 13, the embodiment 39 of FIGS. 9 through 11, has been modified to provide a detachable rectangular applicator 49; having an open cell pad 45 and loofah 46. The detachable applicator 44 allows the reservoir 21 and tube 41 to be used with a variety of applicators. The combined loofah and pad 47 is accomplished by providing a cavity 48 in a generally rectangular applicator housing 50 which is in fluid communication with both the open cell pad 45 and loofah 46 through a series of small apertures 51. In FIG. 14 an embodiment 52 is shown wherein a brush 53 is used in place of the loofah 46 of FIGS. 12 and 13.

Another embodiment 54 of the invention is depicted in FIGS. 15 through 19, inclusive. In this aspect 54, a liquid health or beauty product is also sprayed through a series of small apertures 55 which extend through a small cylindrical upper portion 56 of a circular applicator housing 57. A cylindrical cellular pad 58 is mounted in a lower portion of the housing 57. One distinguishing feature of this embodiment is that a vented filler cap 59 is provided in a closed end portion of a flexible reservoir 60. The vented cap 59 is normally closed when the apparatus 54 is not in use or the reservoir 60 is squeezed and is open after the reservoir 60 is squeezed to replace a discharged portion of a liquid health or beauty product with air. Another feature is that a manual gate valve 61 is provided in an outlet end portion of the reservoir 60 which is manually opened and closed by a user of the apparatus.

The preferred method of using the applicator apparatus shown in FIGS. 1 through 7 is as follows. The reservoir 21 is filled with a liquid health or beauty product. After being filled with the liquid product, the reservoir 21 is connected by a user to the slender elongated triangular member 22 with the threaded fitting 23. The applicator 24 is oriented with respect to the reservoir 21 by rotating the ball and socket joint 32 to suit the requirement of a specific body area. After the user is satisfied with the orientation of the applicator 24, the reservoir 21 is squeezed by the user to disperse a portion of the liquid health or beauty product within the cellular pad 34. The liquid product is then applied to the selected body area with the cellular pad 34. The pad 34 is also used to scrub or cleanse the selected area.

The method of using the embodiment 40 of FIGS. 9 through 11 includes the additional steps of bending and elongating the extensible tubular member 41. The,method of using the embodiment of FIGS. 15 through 19, inclusive, includes the additional step of elongating the slender tubular member 41 and dispersing the liquid health or beauty product on to the selected body area.

From the foregoing it will be appreciated that out invention provides a novel apparatus and method which allows physically disadvantaged as well as persons who are not physically disadvantaged to efficiently apply liquid and beauty products to selected areas of their bodies. It will also be appreciated that our invention is particularly useful to elderly and physically disadvantaged persons who heretofore have required the assistance of others. It will be still further appreciated that our invention can be used at a variety of places, such as beaches, showers, bathtubs, hospitals and nursing homes.

Although only several embodiments have been illustrated and described for purposes of disclosure and enabling persons to practice the invention, it is not our intention to limit our invention to these embodiments, since other embodiments can be derived by obvious substitutions, changes in shape, elimination or additions of parts, and changes in the arrangement of parts without departing from the spirit thereof.

We claim:

1. An applicator apparatus for storing and applying liquid health and beauty products to selected difficult to reach remote areas of a physically challenged person, comprising: a combined flexible reservoir and pump for storing a liquid health or beauty product and dispersing a portion of said liquid health or beauty product through an applicator by squeezing said flexible reservoir and pump, said reservoir and pump having an outlet end portion for discharging a portion of a liquid health or beauty product from said reservoir and pump and a means in said reservoir and pump for automatically venting said flexible reservoir and pump when said applicator apparatus is dispersing said portion of said liquid through said applicator; a check valve in said outlet end portion of said reservoir for preventing a loss of said health or beauty product when said apparatus is not in use, said check valve having a means for automatally opening said check valve when said reservoir is squeezed to discharge said portion of said liquid from said reservoir and pump and for automatically closing said valve when said reservoir is released to prevent a loss of fluid from said reservoir and pump; a slender, substantially elongated non-extensible tubular member for reaching said difficult to reach remote areas, said tubular member having one end portion operatively connected to said outlet end portion of said reservoir and pump; and an applicator pivotally connected to an opposite end portion of said slender elongated non-extensible member for receiving and applying said liquid health or beauty product to said selected remote and difficult to reach remote areas of said person's body.

2. The applicator apparatus recited in claim 1 wherein said applicator is comprised of a frame and an open cell pad attached to one side of said frame.

3. The applicator apparatus recited in claim 1 wherein said applicator is pivotally connected to said opposite end portion of said slender elongated tubular member with a single ball and socket joint.

4. The applicator apparatus recited in claim 1 wherein said slender tubular member is detachable from said outlet end portion of said flexible reservoir.

5. The applicator apparatus recited in claim 1 wherein said means for venting said flexible reservoir and pump comprises a removable cap and valve, said valve having a closed condition when said applicator apparatus is not in use or when said reservoir is squeezed to disperse said liquid through said applicator and a means for automatically opening said valve when said reservoir is released to replace said dispersed liquid portion with air.

6. The applicator apparatus as recited in claim 1 wherein said applicator is a generally rectangular shaped applicator.

7. The applicator apparatus recited in claim 1 wherein said check valve in said outlet portions of said reservoir is a normally closed resilient flapper valve for automatically opening and closing said reservoir's outlet end portion, said flapper valve being closed when said reservoir is not squeezed and automatically opened when said flexible body is squeezed to discharge said health or beauty product.

8. An applicator apparatus for storing and applying liquid health and beauty products to various difficult to reach remote regions of a physically challenged person, comprising; a combined reservoir and pump for storing and discharging a liquid health or beauty product, said reservoir and pump having a flexible generally cylindrical body for storing said liquid health or beauty product and discharging said health and beauty product when said cylindrical body is squeezed, said cylindrical body having a closed end portion and an opposite outlet end portion, a valve for venting said reservoir and pump mounted in said closed end portion of said body, said valve having a means for automatically closing said value when said body is squeezed by a user to discharge a portion of said health or beauty product through said outlet end portion and for automatically opening said valve to admit air into said reservoir after said body is released; a check valve in an outlet end portion of said reservoir for preventing a loss of said health or beauty product when said apparatus is not in use, said check valve having a means for automatically opening said check valve when said body is squeezed to disperse said liquid through said applicator and for automatically closing said valve when said body is released; a substantially elongated slender non-extensible tubular member for reaching said difficult to reach remote areas, said tubular member having one end portion detachably connected to said cylindrical body's outlet end portion and an opposite end portion connected to an applicator for transferring a portion of said health or beauty product from said reservoir to said applicator; said applicator articularly connected to said opposite end portion of said slender elongated member, said applicator having a frame and an open cell pad mounted in said frame a permeable membrane in covering relationship to said open cell pad for distributing said liquid product throughout said open cell pad; and a ball and socket joint for pivotally connecting said applicator to said slender tubular member.

9. The applicator apparatus recited in claim 8 wherein said permeable membrane in covering relationship to an inner surface of said open cell pad for distributing said liquid product throughout said open cell pad.

10. A method for applying heath and beauty products to various difficult to reach remote areas of a physically challenged person's body comprising the steps of adding a liquid health or beauty product through an outlet end portion of a combined flexible slender cylindrical reservoir and pump of an apparatus for applying said health or beauty products to said areas of said person's body; installing a check valve on said outlet end portion of said reservoir and pump to prevent a loss of said health or beauty product from said reservoir when said apparatus is not in use, said check valve having a means for automatically opening said valve when said reservoir is squeezed to discharge a portion of said liquid from said reservoir and for automatically closing said valve when said reservoir is released to prevent a loss of said liquid from said reservoir; connecting one end portion of a substantially elongated slender non-extensible tubular member to said outlet of said reservoir and pump for reaching said difficult to reach remote areas; pivotally connecting an applicator with a ball and socket joint to an opposite end portion of said substantially elongated slender tubular member; rotating said applicator about at least one axis with said bell and socket joint which is attached to said elongated slender non-extensible tubular members; reaching said difficult to reach remote area with said elongated non-extensible tubular member; dispersing said liquid health or beauty product through said applicator by squeezing said flexible reservoir and pump to automatically open said check valve; automatically closing said check valve by releasing said reservoir; automatically venting said cylindrical reservoir during said dispersion of said liquid health or beauty product; and spreading said liquid health or beauty product with said applicator on said selected difficult to reach remote portion of said physically challenged person body.

11. The method as recited in claim 10 further comprising the steps of rotating said applicator about two additional axes which are mutually perpendicular to said other axis.

12. The method as recited in claim 10 further comprising an initial step of attaching said applicator to said slender elongated non-extensible tubular member.

* * * * *